US005102571A

United States Patent [19]

Mole et al.

[11] Patent Number: 5,102,571

[45] Date of Patent: Apr. 7, 1992

[54] AQUEOUS BLEACHING COMPOSITION COMPRISING SODIUM PERBORATE TETRAHYDRATE AND AQUEOUS DETERGENT COMPOSITIONS CONTAINING THE SAME

[75] Inventors: James E. Mole, Utkinton; Michael J. Walker, Northwich, both of United Kingdom

[73] Assignee: Imperial Chemical Industries PLC, London, England

[21] Appl. No.: 433,900

[22] Filed: Nov. 9, 1989

[30] Foreign Application Priority Data

Nov. 11, 1988 [GB] United Kingdom ..... 8826458

[51] Int. Cl.[5] ..... C11D 7/54; C11D 7/18; C11D 3/395; C11D 15/12

[52] U.S. Cl. ..... 252/99; 252/95; 252/135; 252/174.17; 252/DIG. 14; 252/186.3; 252/186.31; 252/186.43

[58] Field of Search ..... 252/95, 99, 186.3, 186.31, 252/186.43, DIG. 14

[56] References Cited

U.S. PATENT DOCUMENTS

| | | | |
|---|---|---|---|
| 3,388,069 | 6/1968 | Lindner et al. | 252/99 |
| 3,402,128 | 9/1968 | Puchta et al. | 252/99 |
| 3,553,140 | 1/1971 | Lindner et al. | 252/99 |
| 3,658,712 | 4/1972 | Lindner et al. | 252/99 |
| 4,017,412 | 4/1977 | Bradley | 252/95 |
| 4,130,501 | 12/1978 | Lutz et al. | 252/95 |
| 4,764,302 | 8/1988 | Baker et al. | 252/301.23 |
| 4,800,036 | 1/1989 | Rose et al. | 252/102 |

FOREIGN PATENT DOCUMENTS

| | | |
|---|---|---|
| 1049482 | 4/1962 | United Kingdom . |
| 976511 | 11/1964 | United Kingdom . |

*Primary Examiner*—Paul Lieberman
*Assistant Examiner*—Erin M. Higgins
*Attorney, Agent, or Firm*—Cushman, Darby & Cushman

[57] ABSTRACT

A bleach formulation comprising an aqueous solution/-suspension of sodium perborate tetrahydrate (preferably "fines") and a thickening agent and optionally and preferably one or more other ingredients of conventional detergent compositions, notably an aqueous sodium silicate solution.

8 Claims, No Drawings

AQUEOUS BLEACHING COMPOSITION COMPRISING SODIUM PERBORATE TETRAHYDRATE AND AQUEOUS DETERGENT COMPOSITIONS CONTAINING THE SAME

This invention relates to a formulation containing a bleaching agent for incorporation in aqueous liquid detergent compositions or for use as a bleach, for example as a bleach booster, together with aqueous liquid detergent compositions or powder detergent compositions in order to confer improved wash performance on the detergent compositions.

Most common detergent compositions for domestic laundry use are provided in the form of powders. These compositions usually contain a bleaching agent which may be, for example, sodium perborate monohydrate or tetrahydrate. Liquid detergent compositions are becoming of increasing importance in the domestic market where they offer the advantages of being easily formulated, dust-free and easy to handle.

Liquid detergent compositions suffer from the disadvantage compared with powder compositions that they do not contain a bleaching agent since addition of such an agent to liquid compositions usually results in rapid decomposition of the bleach leading to evolution of oxygen and pack failure due to over-pressurisation. However, it is desirable to include a bleach in liquid detergent compositions since the absence of a bleach results in loss of cleaning performance and particularly in a reduction of whiteness and failure to remove bleachable stains properly. As a result of not containing a bleach, liquid detergent compositions are generally inferior to powder compositions and require the use of a separate bleach (called a bleach booster).

In making or trying to make liquid detergent compositions containing sodium perborate tetrahydrate, the tetrahydrate in the form of a powder is mixed with the other ingredients of the composition. Usually the tetrahydrate will be mixed into a premixture of the other ingredients, preferably together with a little additional water.

We have now found it to be advantageous to provide the sodium perborate tetrahydrate in the form of an aqueous suspension for incorporation in the liquid detergent compositions and the present invention resides in such a suspension. In addition, in cases where it is preferred not to incorporate the tetrahydrate directly in the detergent owing for example to resulting instability of the compositions, we have found that the aqueous suspension of the invention is a useful bleach in its own right and can be used for instance as a bleach booster for separate addition to the wash together with a liquid or powder detergent composition.

According to the invention there is provided an aqueous bleach composition for incorporation in liquid detergent compositions or for use as a bleaching agent on its own or together with liquid or powder detergent compositions which bleach composition comprises a solution and/or suspension in water of sodium perborate tetrahydrate and a thickening agent. The composition may be in the form of a mobile fluid which can be pumped using conventional liquid-pumping devices or it may be a fluid of high viscosity or a paste or gel.

The bleach composition preferably contains from 30% to 80% by weight of the sodium perborate tetrahydrate based on the composition, the especially preferred amount being from 50% to 75% by weight. Also, the bleach composition preferably contains one or more of a silicate and adjuvant(s) as are conventional in liquid detergent compositions. An aqueous sodium silicate solution in an amount of from 0.2% to about 30% by weight, preferably 1% to about 8% by weight, is an especially preferred ingredient of the bleach composition.

An adjuvant which may usefully be included is a metal chelating agent such as ethylene diamine tetraacetic acid (EDTA), diethylene triamine pentaacetic acid (DTPA), sodium glucoheptonate or a phosphonate as are conventionally employed for sequestering of iron and other transition metals. The adjuvant, if present, will usually be in an amount of from 0.01 to 0.5% by weight of the bleach composition.

The composition will usually be pumpable and the thickening agent is incorporated in the composition in an amount sufficient to raise the viscosity of the composition as high as possible consistent with it being pumpable using conventional liquid-pumping devices. A thickening agent having thixotropic behaviour is preferred. The amount will usually be from 0.01% to about 5% by weight of the bleach composition. Conventional thickening agents are suitable, for example agents based on a cellulose derivative, e.g. hydroxyalkyl cellulose, polysaccharides such as xanthan gums and galactomannan gums, fumed silica and various natural or synthetic clays. Mixtures of thickening agents may be used. Preferred thickening agents are xanthan and xanthan/-galactomannan gums, for example a xanthan/galactomannan gum available under the trade name Deuteron SR28 from W O C Schoner GmbH or a xanthan gum available under the trade name Kelzan K6C169 from Kelco International Ltd. and natural or synthetic clays such as bentonite and Laponite (available from Laporte Industries).

Incorporation of a dispersing agent in the bleach formulation is beneficial in inhibiting agglomeration of the sodium perborate tetrahydrate. Examples of useful dispersing agents are sodium dispersol and polyacrylic acid salts. The dispersing agent will usually be present in an amount of from 0.01% to 0.5% by weight of the bleach composition.

The bleach composition may, if desired, contain a fatty acid of which suitable members are those containing from 12 to 18 carbon atoms, for example oleic acid and ricinoleic acid. The acid may be present in the form of its sodium or potassium salt, in which case the sodium salt is preferred. The amount of the acid, if present, will usually be from 0.5% to 10% by weight of the bleach composition.

Sodium perborate tetrahydrate is a powder material in which the particles are of size generally below 500 microns. Standard grade tetrahydrate having a mean particle size of about 350 microns may be used although for ease of dispersion in water we prefer powders of finer particle size. A preferred form of tetrahydrate is that commonly known as "fines" in which the particle size is below about 160 microns, an especially preferred form being a powder of mean particle size 20 to 50 microns. In general the lower the size of the the perborate particles, the smoother and less gritty will the suspension feel. Reduction in size of the perborate particles can be effected by dry milling before incorporation in the suspension or wet milling during manufacture of the suspension.

As stated above, the bleach composition preferably contains one or more silicates such as a commercially available aqueous solution of sodium silicate. In such solutions, which usually contain from 25% to 40% by weight of sodium silicate, the ratio of silica:sodium oxide may vary within wide limits and we prefer solutions in which the ratio is from 1.5:1 to 3.5:1, especially from 2:1 to 2.5:1. Sodium silicate solutions act as buffering agent(s) and stabilizer(s) for the bleach composition (and for the resulting detergent composition in the case where the bleach composition is incorporated in a detergent composition) and also are anti-corrosive agents.

The liquid detergent composition into which the bleach composition is incorporated or the liquid or powder detergent composition with which the bleach composition is used may be any of the known detergent compositions. These known compositions may contain both an anionic surface active agent and a non-ionic surface active agent, such a mixture together with a fatty acid soap providing a composition which is stable over a wide range of temperatures. The surface active agents are preferably soluble in water. Any anionic surface active agent may be used but a preferred agent is a sulphate or particularly a sulphonate detergent. Examples of anionic agents which may be used are the alkali metal salts of C10 to C20 alkane sulphonates and C10 to C20 olefin sulphonates. Alkali metal salts of (linear) alkyl benzene sulphonates are preferred, particularly those containing 10 to 14 carbon atoms. An especially preferred agent is sodium dodecyl benzene sulphonate.

The non-ionic surface active agent may be any of the agents commonly included in detergents, particularly the alkylene oxide condensates of aliphatic alcohols having less than 22, say from 9 to 15, carbon atoms. The alkylene oxide may be ethylene oxide or propylene oxide or a mixture thereof. Butylene oxide may also be used but is less common. The number of alkylene oxide units in the condensate may vary widely, for example from 3 to 20, but will usually be about 4 to 9. An example of a useful agent is the ethylene oxide condensate of a mixture of C13 and C15 alcohols containing about 7 ethylene oxide units.

The fatty acid soap will usually be derived from an acid of from 12 to 18 carbon atoms such as oleic, ricinoleic, stearic and lauric acids and acids derived from castor oil, rapeseed oil, coconut oil, groundnut oil and palm oil and mixtures thereof: sodium and potassium salts of these oils are soaps.

The detergency builder will usually be a phosphate although other types of builder, e.g. carbonates, citrates, polycarboxylates and zeolites may be used. Alkali metal salts of phosphoric, orthophosphoric, metaphosphoric and tripolyphosphoric acids are useful, especially tripolyphosphates. The preferred builder is sodium tripolyphosphate.

The bleach formulation according to the invention may contain one or more adjuvants in addition to those mentioned hereinbefore. Included amongst such adjuvants are polyethylene glycols, UV stabilisers, enzymes (proteolytic or amylytic enzymes or mixtures thereof) and perfumes.

The bleach compositions of the invention will usually have a viscosity in the range of about 500 mPa. to about 10000 mPa. at 20° C., the preferred compositions exhibiting shear thinning behaviour so enabling them to be poured and pumped easily.

The pH of the composition may be anywhere within the alkaline region but is preferably about 8.5 to 10.

The bleach compositions of the invention are stable, smooth, easily-dispersed suspensions which can be incorporated in liquid detergents or can be used in their own right as bleaching agents.

The invention is illustrated by the following examples:

EXAMPLE 1

A bleach composition according to the invention was prepared to the following formulation by adding the thickener (gum) to the water and stirring the mixture until the solution was clear, then adding the other ingredients and stirring again.

| | |
|---|---|
| Xanthan gum | 0.54 g |
| Water | 180 g |
| Polyacrylic acid salt | 0.22 g (active) |
| EDTA | 0.4 g |
| Sodium silicate solution | 8 g |
| Sodium perborate tetrahydrate | 220 g |

The xanthan gum was Kelzan K6C169 from Kelco International Ltd.

The polyacrylic acid salt was Dispex N40 from Allied Colloids Ltd.

The sodium silicate solution was E100 which is a 42% by weight solution with a silica:sodium oxide weight ratio of 2.21:1.

The sodium perborate tetrahydrate was "fines" of particle size below 160 microns.

The formulation was a smooth, homogeneous suspension of viscosity 700 mPa as measured on a Brookfield RVTD viscometer with No.4 spindle.

The suspension was left to stand for a few days and was then re-examined. There was no evidence of phase separation and no loss of available oxygen, demonstrating that the composition exhibited good phase stability and good oxygen stability.

EXAMPLE 2

A bleach composition was made up to the following formulation:

| | |
|---|---|
| Xanthan gum | 0.54 g |
| Water | 180 g |
| Dispex N40 | 0.27 g |
| EDTA | 0.45 g |
| Sodium silicate solution | 9 g |
| Tetrahydrate | 270 g |

The ingredients were the same as in Example 1.

The suspension had a viscosity of 7600 mPa (Brookfield RVTD viscometer with No.4 spindle) and exhibited good phase and oxygen stabilities. The suspension was pourable.

EXAMPLE 3

A bleach composition was made up to the following formulation:

| | |
|---|---|
| Xanthan/galactomannan gum | 0.72 g |
| Water | 180 g |
| EDTA | 0.45 g |
| Sodium silicate solution (E100) | 9 g |
| Tetrahydrate (fines) | 270 g |

The gum was Deuteron SR28 from Schoner GmbH. The water and the gum were mixed together for 30 seconds in a laboratory mixer and the other ingredients were then mixed into the solution.

The suspension showed phase stability in excess of three months and remained mobile over this period with no visible loss of available oxygen.

EXAMPLE 4

Three suspensions A,B and C were made up using the procedure of Example 3 to the following formulation different grades of sodium silicate solutions.

| | |
|---|---|
| Xanthan/galactomannan gum (SR28) | 0.9 g |
| Water | 180 g |
| EDTA | 0.45 g |
| Sodium silicate solution | 9 g |
| Tetrahydrate (fines) | 270 g |

The silicate solutions used were:

A - 2% w/w of A120 with silica:sodium oxide weight ratio of 1.6:1

B - 2% w/w of C100 with silica:sodium oxide weight ratio of 2.0:1

C - 2% w/w of E100 with silica:sodium oxide weight ratio of 2.21:1

The available oxygen in each suspension was measured and the suspensions were allowed to stand for 60 days at 30° C. after which the available oxygen was again measured. Over the test period there was no evidence of phase separation and the suspensions remained pourable.

| | Results: | | |
|---|---|---|---|
| | A | B | C |
| Initial Oxygen | 6.1 | 6.1 | 6.1 |
| 60 day Oxygen | 5.91 | 6.06 | 6.05 |
| % loss of Oxygen | 3.11 | 0.66 | 0.82 |

EXAMPLE 5

A suspension was made up to the following formulation:

| | |
|---|---|
| Water | 200 g |
| Laponite RDS | 2 g |
| Sodium silicate solution (E100) | 8 g |
| EDTA | 0.4 g |
| Tetrahydrate (fines) | 200 g |
| Dispex N40 | 0.04 g |

Laponite RDS is available from Laporte Industries. The Laponite and the water were mixed until the solution was clear and the other ingredients were then added. A smooth, homogeneous suspension resulted which was phase stable and remained mobile for several weeks.

EXAMPLE 6

A bleach composition was made up to the following formulation:

| | |
|---|---|
| Xanthan gum | 0.8 g |
| Water | 150 g |
| EDTA | 0.45 g |
| Sodium silicate soln. (E100) | 9 g |

-continued

| | |
|---|---|
| Tetrahydrate (fines) | 300 g |

Samples of the suspension were incorporated by stirring into two commercially-available liquid detergent compositions:

| | |
|---|---|
| Detergent A | |
| sodium C12-alkyl benzene sulphonate | 6.5% w/w |
| C13/C15 alcohol/7 ethoxylate | 2.5 |
| Potassium oleate | 1.6 |
| Sodium tripolyphosphate | 27 |
| Sodium silicate | 4 |
| Water | 53 |
| Stabilizers | 3 |
| *Miscellaneous | 24 |
| Detergent B | |
| sodium C12-alkyl benzene sulphonate | 6.67% |
| C13/C15 alcohol/7 ethoxylate | 3.3 |
| PEG 200 | 8 |
| Sodium tripolyphosphate | 17.5 |
| Carboxymethylcellulose | 0.5 |
| V-gum | 0.5 |
| Kelzan S | 0.1 |
| Tinapol CBS-X | 0.3 |
| Enzymes | 0.2 |
| Perfume | 0.2 |
| Water | Balance |

*Enzymes, perfumes, opticalbrighteners, anti-redeposition agent 50 g of the bleach composition was added to 175 g each detergent and the mixtures were repacked and allowed to stand at 30° C. for several weeks.

Detergent A+bleach was examined after 29 days and showed excellent phase stability over the 29 day period with only slight pressurisation of the pack. After 2 months, available oxygen loss was modest at 36% of the initial value.

Detergent B+bleach showed excellent phase stability but exhibited initial foaming and pressurisation of the pack. Available oxygen loss stabilised after 10 days and over a two month period was only 26% of the initial value.

EXAMPLE 7

A bleach composition was made up to the following formulation:

| | |
|---|---|
| Xanthan gum | 0.9 g |
| Water | 150 g |
| EDTA | 0.45 g |
| Sodium silicate solution (E100) | 9 g |
| Tetrahydrate (fines) | 300 g |

The gum and water were mixed together prior to adding the other ingredients.

Samples of the bleach composition were incorporated into Detergents A and B (Example 6) at the level of 15% by weight sodium perborate.

The resulting bleach-containing detergent compositions were similar in behaviour to those described in Example 6.

EXAMPLE 8

This example illustrates the use of bleach compositions according to the invention as bleach boosters added separately to the wash. 2 Kg (half-load) of stained and unstained cloth, as below, were washed in a standard front-loading washine machine (a Miele electronic machine) at No.2 wash setting, using separate additions of a commercially-available liquid detergent and the bleach suspension described in Example 1. The doses were 130 g of liquid detergent and 50% of the bleach suspension. For purposes of comparison a similar load was washed in the same way using the liquid detergent only at a dosage of 180 g.

The above washes were carried out at a temperature setting of 60° C. Further washes were carried out as above but at a temperature setting of 90° C.

After washing and drying, the reflectance of the cloth samples was determined to assess wash performance and the reflectance figure was compared with that of the unwashed samples. A % removal of soil figure was calculated from the reflectance figures and the results are given below. The cloth samples and the stains used were:

| | |
|---|---|
| Cloth | |
| C1 | Cotton cloth from Krefeld standard pigment/grease soiling |
| C2 | Cotton cloth from EMPA standard pigment/oil soiling |
| C3 | Polyester cloth from Krefeld standard pigment/grease soiling |
| C4 | Polyester from EMPA standard pigment/oil soiling |
| Stains (on cotton from EMPA) | |
| S1 | Milk/Blood/Carbon black mixture |
| S2 | Blood |
| S3 | Red wine |
| S4 | Cocoa |
| The liquid detergents used were: | |
| D1 | Wisk |
| D2 | Detergent B as in Example 6 |

TABLE 1

RESULTS
I - 60° C. Wash.

| | % Removal of Soils | | | | | | | |
|---|---|---|---|---|---|---|---|---|
| | C1 | C2 | C3 | C4 | S1 | S2 | S3 | S4 |
| D1 | 68.8 | 39.2 | 35.1 | 53.0 | 83.3 | 93.5 | 61.3 | 38.0 |
| D1/bleach | 81.9 | 53.0 | 40.6 | 67.7 | 61.3 | 93.1 | 83.0 | 57.5 |
| D2 | 72.1 | 42.1 | 59.7 | 56.2 | 84.0 | 93.7 | 51.6 | 56.8 |
| D2/bleach | 72.1 | 43.7 | 66.2 | 60.5 | 71.7 | 95.8 | 70.3 | 60.5 |

| | *Total Removal of Soils |
|---|---|
| D1 | 472.2 |
| D1/bleach | 538.1 - 14% increase |
| D2 | 516.2 |
| D2/bleach | 540.7 - 4.7% increase |

*Total Removal of Soils is the sum of the individual % removals of soil.

The results show that addition of the bleach booster to the wash improves the wash performance achieved. The individual results show a general improvement in wash performance in respect of all the cloths and stains examined with the exception of stain S1 in which it is believed the perborate denatures the stain before the enzymes/detergents can remove it.

TABLE 2

II - 90° C. Wash.

| | % Removal of Soils | | | | | | | |
|---|---|---|---|---|---|---|---|---|
| | C1 | C2 | S1 | S2 | S3 | S4 | S5 | S6 |
| D1 | 72.5 | 51.6 | 84.7 | 95.0 | 69.7 | 48.0 | 40.8 | 71.7 |
| D1/bleach | 74.3 | 49.7 | 56.3 | 94.1 | 92.8 | 55.3 | 85.2 | 86.5 |
| D2 | 75.9 | 47.8 | 85.5 | 95.6 | 64.6 | 59.9 | 26.2 | 74.3 |
| D2/bleach | 80.2 | 43.9 | 67.9 | 97.1 | 93.3 | 56.1 | 78.7 | 87.2 |

| | Total Removal of Soils |
|---|---|
| D1 | 534.0 |

TABLE 2-continued

II - 90° C. Wash.

| | |
|---|---|
| D1/bleach | 594.2 - 11.3% increase |
| D2 | 529.8 |
| D2/bleach | 604.4 - 14.1% increase |

* S5 and S6 were cotton samples from EMPA stained with tea and coffee respectively.

As in the case of the results of the 60° C. wash, these results show a general overall improvement in wash performance. In the 90° wash, however, improved performance is not achieved in respect of all stains but especially large improvements were noted in respect of the bleachable stains tea, coffee and red wine.

EXAMPLE 9

Stained and unstained cloth samples (2 Kg) were washed as in Example 1 using a liquid detergent (180 g) in which was incorporated the bleach composition described in Example 1. The cloths and stains used were as described in Example 8.

The results of % soil removal calculations were:

TABLE 3

I - 60° C. Wash.

| | % Removal of Soils | | | | | | | |
|---|---|---|---|---|---|---|---|---|
| | C1 | C2 | C3 | C4 | S1 | S2 | S3 | S4 |
| D1 | 68.8 | 39.2 | 35.1 | 53.0 | 83.3 | 93.5 | 61.3 | 38.0 |
| D1/bleach | 73.5 | 44.2 | 35.8 | 60.3 | 52.4 | 89.6 | 72.7 | 36.8 |
| D2 | 72.1 | 42.1 | 59.7 | 56.2 | 84.0 | 93.7 | 51.6 | 56.8 |
| D3 | 69.5 | 41.3 | 63.5 | 45.7 | 64.9 | 86.5 | 58.7 | 27.1 |
| D3/bleach | 79.5 | 52.0 | 73.1 | 69.4 | 37.8 | 89.9 | 76.8 | 29.9 |

| | Total Removal of Soils |
|---|---|
| D1 | 472.2 |
| D1/bleach | 465.3 |
| D2 | 516.2 |
| D3 | 457.2 |
| D3/bleach | 508.4 |

D1 was "Wisk" liquid detergent.
D2 was Detergent B of Example 6.
D3 was Detergent B Example 6, without enzymes.

TABLE 4

II 90° C. Wash.

| | % Removal of Soils | | | | | | | |
|---|---|---|---|---|---|---|---|---|
| | C1 | C2 | S1 | S2 | S3 | S4 | S5 | S6 |
| D1 | 72.5 | 51.6 | 84.7 | 95.0 | 69.7 | 48.0 | 40.8 | 717 |
| D1/bleach | 81.1 | 55.3 | 57.8 | 93.5 | 96.9 | 46.1 | 76.3 | 95.0 |
| D2 | 75.9 | 47.8 | 85.5 | 95.6 | 64.6 | 59.9 | 26.2 | 74.3 |
| D3 | 77.9 | 45.3 | 71.0 | 90.4 | 70.3 | 40.1 | 49.6 | 75.8 |
| D3/bleach | 75.7 | 51.8 | 35.6 | 92.2 | 95.7 | 35.5 | 84.8 | 87.1 |

| | Total Removal of Soils |
|---|---|
| D1 | 534.0 |
| D1/bleach | 602.0 |
| D2 | 529.8 |
| D3 | 520.4 |
| D3/bleach | 558.4 |

The results in Table 3 show that incorporation of the bleach composition in the liquid detergent causes no significant change in overall wash performance at 60° C. and overcomes the effects shown by the omission of enzymes from the detergent D2. As must be expected, the sodium perborate results in enhanced wash performance in respect of bleachable stains at the expense of enzymatic stains.

Overall wash performance at 90° C. is enhanced by the sodium perborate addition with particularly good results shown in respect of bleachable stains (S3, S5 and S6).

The results in Tables 3 and 4 indicate that liquid detergents formulated to include sodium perborate tetrahydrate suspensions can at least equal the wash performance of standard biological liquid detergents without the need to include enzymes.

EXAMPLE 10

A bleach suspension was made up to the following formulation and packed in sealed packs:

| | |
|---|---|
| Xanthan gum | 1.30 g |
| Water | 330 g |
| Dispex N40 | 7.7 g |
| EDTA | 1.0 g |
| Sodium silicate solution | 20.0 g |
| Tetrahydrate (dry milled to a median size of 40 microns) | 650 g |

The suspension had a viscosity of 2000 mPa at 20° C. as measured on a Brookfield RVTD viscometer with No 4 spindle.

On standing for 50 days there was no evidence of phase separation in the suspension and no pack pressurisation. A residual available oxygen level of 95% of the original value was determined.

EXAMPLE 11

A bleach composition was made up to the following formulation and packed in sealed packs:

| | |
|---|---|
| Xanthan gum | 1.3 g |
| Water | 330.0 g |
| Dispex N40 | 7.7 g |
| EDTA | 1.0 g |
| Sodium silicate solution | 20.0 g |
| Tetrahydrate (wet milled to a median size of 40 microns) | 650 g |

On standing for 50 days there was no evidence of phase separation in the suspension or pack pressurisation. A residual available oxygen level of 95% of the initial value was determined.

EXAMPLE 12

A sample of suspension as produced according to Example 10 was incorporated into a structured liquid laundry product as described for detergent A in Example 6, by gentle stirring. The product was packed in sealed packs.

On standing for 50 days no phase separation in the product or pack pressurisation occurred, and the available oxygen level remaining was 75–80% of the initial value. The viscosity of the formulated product was 860 mPa initially, rising to 1010 mPa on storage for 50 days (measured by a Brookfield RVTD viscometer with No 4 spindle).

We claim:

1. An aqueous bleach composition comprising a solution or suspension of sodium perborate tetrahydrate and a thickening agent selected from the group consisting of cellulose derivatives, polysaccharides, silica and clays, the sodium perborate tetrahydrate being present in the amount of from 30% to 80% by weight of the composition and the thickening agent being present in the amount of from 0.1% to 5% by weight of the composition so that the composition has a viscosity of from 500 mPa to 10,000 mPa at 20° C., the sodium perborate tetrahydrate being in the form of fines of particles size below about 160 microns.

2. A composition as claimed in claim 1 wherein the mean particle size of the tetrahydrate particles in from 20 to 50 microns.

3. A composition as claimed in claim 1 wherein the thickening agent is a xanthan or galactomannan gum.

4. A composition according to claim 1 which includes from 0.2% to 30% by weight of sodium silicate.

5. A composition as claimed in claim 4 which contains sodium silicate wherein the ratio of silica to sodium oxide is from 1.5:1 to 3.5:1.

6. A composition as claimed in claim 4 which contains a dispersing agent for the tetrahydrate particles.

7. A composition as claimed in claim 4 having a pH of from 8.5 to 10.

8. An aqueous detergent composition including the bleaching composition of claim 1 and a surface active agent.

* * * * *